United States Patent [19]

Davis

[11] 4,333,974

[45] Jun. 8, 1982

[54] CANDY-COVERED FIGURINE AND METHOD OF PRODUCING

[76] Inventor: Frances P. Davis, 4808 Holston Heights La., Knoxville, Tenn. 37914

[21] Appl. No.: 81,021

[22] Filed: Oct. 1, 1979

[51] Int. Cl.[3] ..... A01N 1/00; B32B 7/08; B23P 3/00; B23P 25/00; B23P 11/00

[52] U.S. Cl. ..... 428/16; 29/432; 29/458; 29/460; 46/22; 46/116; 46/151; 156/92

[58] Field of Search ..... 29/460, 432, 458; 428/7, 8, 9, 15, 20, 16; 46/22, 115, 116, 151, 156–161; 156/92, 306

[56] References Cited

U.S. PATENT DOCUMENTS

| | | | |
|---|---|---|---|
| D. 163,517 | 6/1951 | Hansen | 428/7 X |
| 1,839,889 | 1/1932 | Palais | 29/460 X |
| 2,654,608 | 10/1953 | Liebers | 156/92 X |
| 3,181,261 | 5/1965 | Swartz | 46/22 UX R |
| 3,264,160 | 8/1966 | Donofrio | 428/16 X |
| 3,574,968 | 4/1971 | Schlau | 46/151 X R |
| 3,841,019 | 10/1974 | Lorenzo | 46/22 X |
| 3,911,617 | 10/1975 | Gelfand | 46/151 |

*Primary Examiner*—Charlie T. Moon
*Attorney, Agent, or Firm*—Pitts & Kesterson

[57] ABSTRACT

Colorful candy-covered whimsical figurines and a method of producing such figurines are disclosed. The figurines and method of this invention use inexpensive materials having great flexibility such that a great number of different type characters can be readily fabricated. The method includes the use of styrofoam members having reinforced junctures as the basic structure. The head member and other exposed members may be painted as necessary to provide facial details and desired whimsical features. In addition to attaching colorfully-wrapped candies, other decorative details are also included.

18 Claims, 14 Drawing Figures

CANDY-COVERED FIGURINE AND METHOD OF PRODUCING

BACKGROUND OF THE INVENTION

This invention relates to the fabrication of whimsical figurines or characters, in general, and more particularly to the production of colorful candied-covered characters with the use of inexpensive materials and by a fast and simple process.

Candy covered figurines are used in numerous applications for amusement and business purposes. For example, the figurines are used as toys for children and have candy attached to the body members. The candy can be detached, unwrapped and eaten. In certain applications the figurines are used as promotional or advertising objects and table ornaments.

Heretofore, known candy-covered figurines suffer certain disadvantages. More specifically, where the figurine is used as a toy by children, the head and body members tend to break apart when minor stress is placed on the head-body juncture of certain figurines which embody two discrete members which are joined to form the foundation of the figurine structure. Moreover, it is desirable where the figurine serves as a toy, to secure the candy on the figurine in a manner such that it can still be removed and eaten without exposing a child to a dangerous object which might be ingested. It is also desirable to make the figurines as quickly as possible to save labor costs during manufacturing.

Therefore, it is an object of this invention to provide a method of fabricating candy-covered figurines with inexpensive materials.

It is still another object of this invention to provide a simple and fast method of fabricating candy-covered figurines.

It is yet another object of the invention to provide a method of fabricating structurally sturdy candy-covered figurines having reinforced junctures.

A further object of one embodiment of the invention is to provide a method and apparatus for securing the candy to the figurines without using objects which are dangerous if ingested by small children. Other objects and advantages of the invention will become apparent upon reading the following detailed description together with the figures.

SUMMARY OF THE INVENTION

To accomplish the above mentioned objects as well as other objects which will become evident from the following drawings and detailed description, the present invention discloses a process for the manufacturing of a figurine partially covered with candy. The method comprises steps of joining a body member with a head member by means of an adhesive-colored elongated member such as, for example, a wooden stick or dowel. Feet or support structure are connected to the body member by joining a lower extremity member at an end opposite the point of joining the two head and body members manufactured from a material such as styrofoam. Arm and hand members which may be made out of six or seven ply illustration board, for example, may then be attached to the body member. The juncture between all of these members may then be reinforced by dipping the head-body and body-feet junctures into reinforcing liquid. Facial features such as eyes, ears, and mouth members are then attached to the styrofoam head member at depressions previously formed therein.

Thus the exposed styrofoam head and body members are then colored as necessary to provide the desired flesh tones. In addition, detailed facial features may be painted onto the styrofoam head member. The figurine is then completed by attaching selected decorative details such as hair, hat, hand-held articles and clothing at desired locations on the exposed members and finally, securing colorfully-wrapped candies at locations to the styrofoam members.

Accordingly, the above mentioned objects and subsequent description will be more readily understood by reference to the following drawings wherein:

DESCRIPTION OF THE INVENTION

Figures 1, 2, 3, 4, 5, 6, 7, 8:
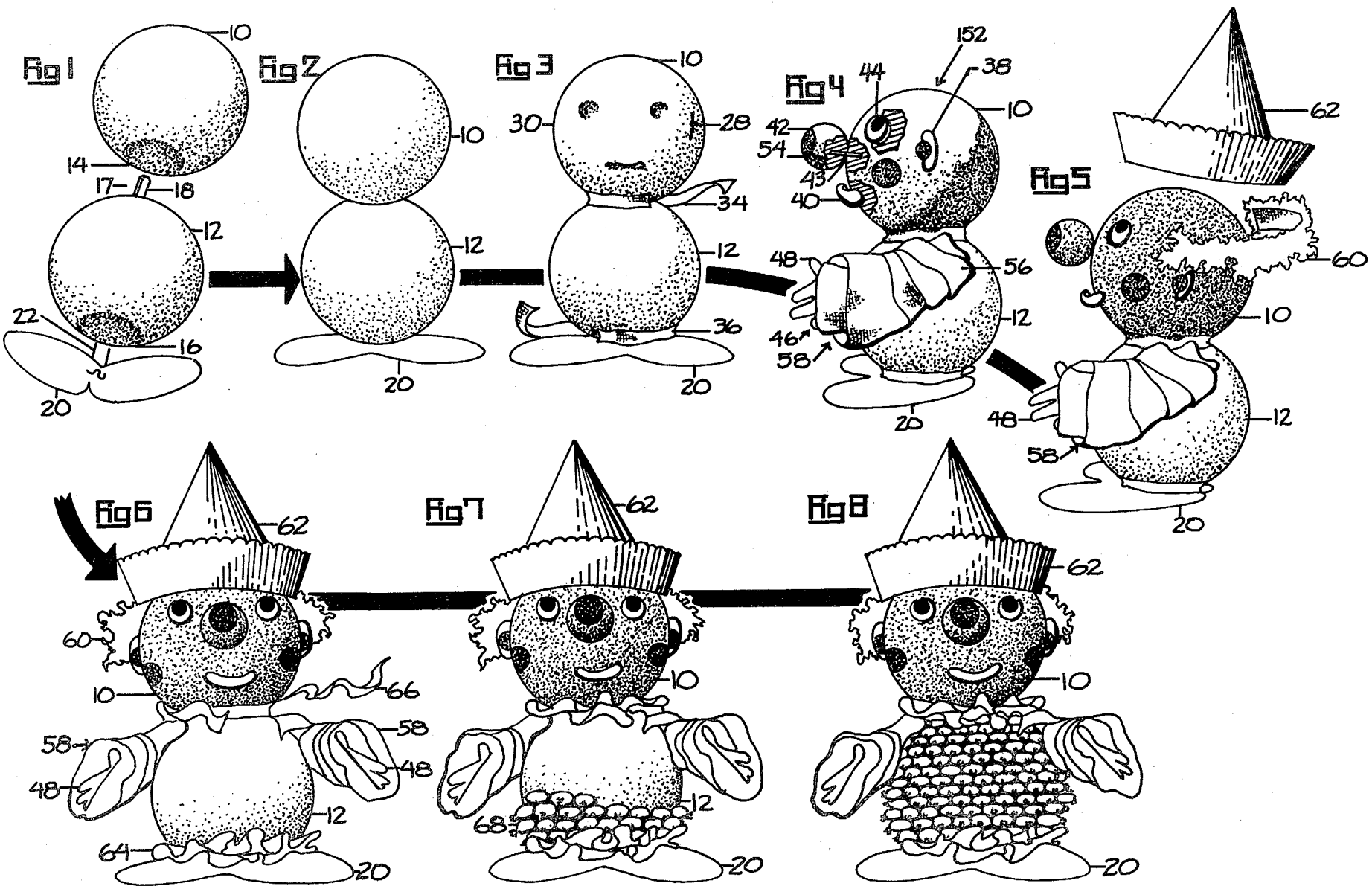
FIGS. 1 through 8 illustrate a step-by-step process for the production of the figurines according to the method of this invention.

Referring now to FIGS. 1 through 8 there is shown a step-by-step illustration of various steps of the process of this invention for producing candy-covered figurines. As shown in FIG. 1, two substantially spherical members are provided which are penetrable and can be shaped, such as styrofoam balls 10 and 12 having a size selected according to the desired size of the finished figurine such as, for example 4" or 6" styrofoam balls. The head member or styrofoam ball 10 has a flattened portion 14, and styrofoam ball 12 has two flattened portions 16 and 17 (17 not shown) which flattened portions are opposite each other. An elongated member 18 having a first end (not shown) is coated with an adhesive or cement and pushed into styrofoam ball 12 at flattened portion 17. The other end or exposed end of the elongated member 18 now held by the body member or styrofoam ball 12 as shown in FIG. 1, is also coated with an adhesive. The flattened portion 14 of styrofoam ball 10 is then pushed onto elongated member 18 till flat portion 14 comes in contact with flattened portion 17 of styrofoam ball 12. Lower extremities such as, for example, feet member 20 are then attached to the flattened portion 16 of styrofoam ball 12 by means of a staple-like wire member such as, for example, a foilage pin 22 and an adhesive, or by other suitable means described hereinafter. It will be appreciated that feet member 20 could be made of any suitable hard and substantially rigid sheet material. However, 6 or 7 ply illustration board is particularly suitable and inexpensive for use with this process. The adhesive used on elongated member 18, feet member 20, and at other locations may be any suitable adhesive such as, for example, common white household glue. FIG. 2 shows the styrofoam balls 10 and 12 and feet member 20 of FIG. 1 in the proper position, and the glue holding these elements together is allowed to dry.

Referring now to FIG. 3, it is seen that depressions 24 and 26 are made in the styrofoam ball 10 for eye sockets and slits 28 and 30 (30 not shown) are made on each side to receive ears. Another slit 32 is formed in the area where the mouth will be placed. These slits and depressions are preferably formed by pressing a member having the shape of the depression or slit into the ball at the desired location. As is shown in FIG. 3, the juncture between styrofoam balls 10 and 12, i.e. the head-body juncture, may be reinforced by the use of a strip of tape 34, such as sculpture modeling tape which is dipped in water then wrapped around the juncture between styrofoam balls 10 and 12. Edges of the sculpture tape are then smoothed such that they blend or feather into the styrofoam balls. In a similar manner, a strip of sculpture tape 36 is also wrapped around the juncture between feet element 20 and styrofoam ball 12, i.e. the body-feet juncture, to reinforce this juncture.

As is shown in FIG. 4, halves of saucer-shaped chips, such as styrofoam chips, as shown at 38 and 40 have their straight sides coated with adhesive and are inserted in the respective ear and mouth depressions or slits. Although any type of small saucer shaped material may be used, it has been found for purposes of this invention that standard styrofoam packing chips are inexpensive and can readily be cut into and used for this purpose. Other materials such as hard rubber, plastic, cardboard, etc., could, of course, be used.

Depending upon the facial characteristics desired on the figurine, a large bulbous nose may also be included. In the example shown in FIG. 4, a small styrofoam ball 42 such as, for example, on the order of ½" or 1" may be used as a nose. Styrofoam ball 42 is attached in the proper location on styrofoam ball 10 in the same manner as styrofoam balls 10 and 12 were joined. That is, an elongated member such as a stick 43 is coated on both sides with adhesive and pushed into place in small styrofoam ball 42. The combination stick and small ball 42 is then pushed into the proper location of head styrofoam ball 10 and allowed to dry. Subsequent to the affixing of the ears, mouth and nose portions 38, 40 and 42 to the styrofoam ball 10, styrofoam ball 10 along with the eye, mouth and nose portions 58, 40 and 42 are painted or otherwise colored to take on desired flesh coloration. For example, modeling paste may be mixed one-to-one with red oxide acrylic polymer to achieve one type of suitable color covering styrofoam ball 10 and the ear, mouth and nose portions 38, 40 and 42, respectively.

An alternate method of both reinforcing the juncture between styrofoam balls 10 and 12 other than using the sculptural tape will now be discussed. This method also results in a light flesh tone for the head portion 10 of the figurine. According to this alternate method, a mixture of 2 parts water based acrylic latex polymer such as Rohm and Haas AC-507, 1 part red oxide acrylic polymer such as Hyplar (Trademark and Manufactured by M. Grumbacher, Inc., New York, N.Y.) and 1 part water is prepared. The water based acrylic latex polymer is substantially white in color and the addition of the red oxide (coloring additive) provides a flesh tone. The head portion of the figurine, that is, styrofoam ball 10 with the ear, mouth and nose portions 38, 40 and 42 attached thereto, are dipped fully into the mixture. The head portion is dipped to a point such that the head-body juncture between styrofoam balls 10 and 12 is thoroughly covered by the mixture. The styrofoam structure is then removed from the mixture and set upright by feet elements 20 and allowed to dry in one embodiment. The embodiment excess mixture on head portion 10 tends to run down styrofoam ball 10 and collect at the juncture between styrofoam balls 10 and 14 thereby providing a reinforced adhesive juncture between these two members. It will further be appreciated that by using this technique, the nose, ears and mouth portions are also covered with the mixture and obtain the proper flesh tones. Moreover, the mixture assists to secure these members to the head member. If a substantially white color is desired such as is often used for clowns, white titanium oxide may be substituted for the red oxide. In addition, for darker skin tones black or brown oxide may be substituted. To achieve a smoother finish, 2 tablespoons of a liquid detergent may be added per quart of the dipping mixture.

Commercial toy eyes 44 are then placed into depressions 24 and 26 while the structure is still wet from being dipped in the mixture and are thereby adhesively maintained in position. It will be appreciated that toy eyes 44 are readily available and are commercial items on the market. The structure is then typically set aside and allowed to dry after the dipping process for approximately 24 hours. Of course, if the reinforcement between member 10 and 12 is accomplished by sculptural tape as discussed heretofore, eyes 44 may be adhesively maintained in position by use of standard adhesive.

The body-feet juncture between feet member 20 and styrofoam ball 12 may also be reinforced by using sculpture tape or in a manner similar to that just described by preparing a mixture which includes a water based acrylic latex polymer such as Rohm and Haas AC-507, 1 part water and a brown acrylic polymer suitable for shoe or feet color. In this technique the feet and bottom portion of the styrofoam ball 12 are dipped in the mixture and then allowed to dry. More specifically, the juncture between the ball 12 and the member 20 is reinforced in one embodiment, by dipping the member 20 and the lower portion of the ball 12 into the above identified mixture having a shoe or foot color additive. The structure is then removed from the mixture and set or hung upright and allowed to dry. The excess mixture on the ball 12 tends to run down styrofoam ball 12 and collect at the juncture between this ball and the member 20, thereby providing reinforcement for the juncture.

Figure 9:
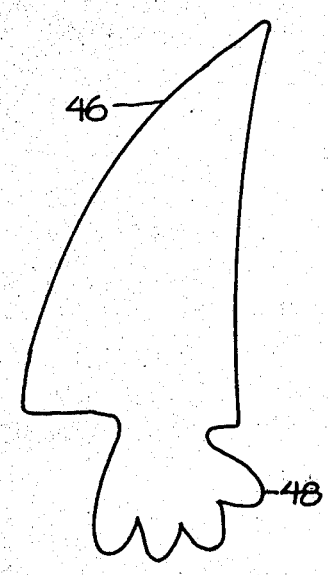
FIG. 9 shows the detail of a hand and arm member suitable for use with the illustrated figurine of FIG. 8.

Upper extremity portion such as hand and arm combination 46 are then prepared from a rigid sheet material such as, for example, 6 or 7 ply illustration board. Typically arm and hand combinations 46 might have the configuration such as shown in FIG. 9. The areas to be exposed such as hand end 48 of arm and hand combination 46 may then be painted or dipped in the mixture discussed above to obtain the desired flesh coloration. Hand and arm combination 46 may be attached to styrofoam ball 12 by coating end 50 with an adhesive and inserting the end into a slit formed in styrofoam ball 12 in a manner similar to that discussed above with respect to ear slits 28 and 30.

Subsequent to achieving the desired coloration of styrofoam ball 10 and small nose ball 42 either by painting or dipping as discussed above, facial features are then applied by such methods as hand painting or air brushing. Thus, as is shown in FIG. 4, cheek spots 52, and a red nose spot 54 as well as other decorations may be applied.

Commercially available ribbon 56 of a selected color is wrapped around arm and hand combination 46 to form sleeves 58. To produce a more attractive type sleeve 58, it may be desirable to gather ribbon 56 on a sewing machine prior to wrapping around the arm and hand combination. If desired, hair and other decorations may be applied to the figurine such as is shown in FIG. 5. According to FIG. 5, a strip of acrylic fur 60 approximately ½"×6" with a fabric backing is spread with adhesive and secured to ball 10 to provide a hair line. Additional hair or a hat such as shown at 62 of a desired configuration may also then be attached to the head of the figurine.

Thus, referring now to FIG. 6 there is shown a front view of the figurine, partially completed. An additional strip of ribbon such as used for sleeves 58 is then spread with adhesive and secured as a skirt 64 at the juncture between styrofoam ball 12 and foot elements 22. In a similar manner, a ribbon strip 66 is secured at the juncture between styrofoam ball 10 and styrofoam ball 12 to serve as a ruffled collar. A great number of small, hard, candies of a preselected color and wrapped preferably in cellophane are then secured to the body styrofoam ball 12 in all visible area. These candies are shown as 68 and their method of attachment shown in more detail in FIGS. 10 and 11. According to FIG. 10 and 11, it is seen that the candies are attached according to one technique by covering end 70 of the candy wrapper end into the styrofoam ball 12 by a small thin stick or rigid implement 72 such as shown in FIG. 11. Once the candy is in place the implement 72 is, of course, removed. FIG. 8 shows a complete figurine produced by the invention of this method which illustrates the complete body styrofoam ball 12 covered with the hard, colorful, wrapped candies 68. It will be recognized the candy secured as just described, can be removed and eaten without exposing anyone, particularly a child to a sharp object which could be ingested.

Figure 12:
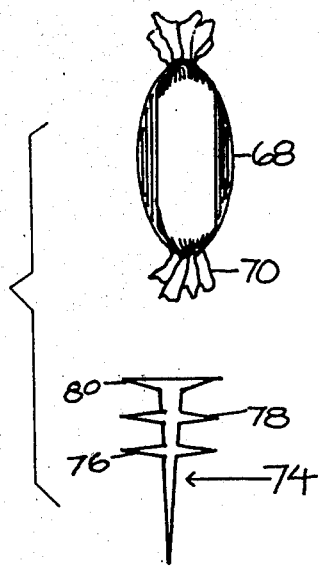
FIG. 12 shows an alternate method of attaching the candies to the body members used in fabricating the figurines of this invention.
Figure 10:
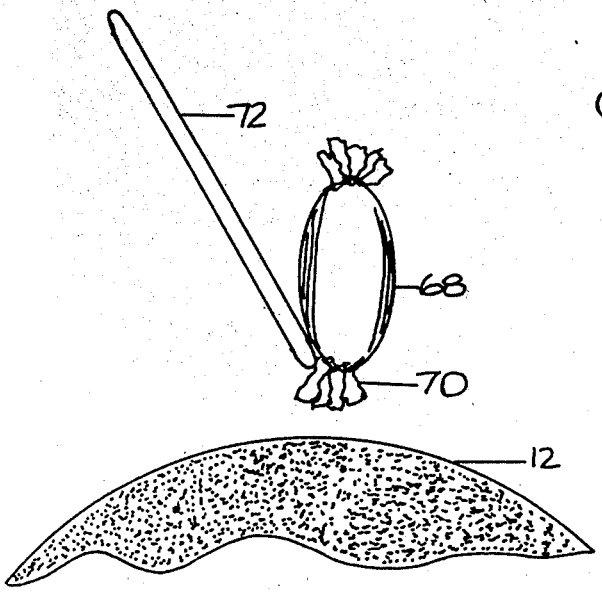
FIGS. 10 and 11 show one technique of attaching colorfully-wrapped candy to the body members used in fabricating the figurine of this invention.
Figure 11:
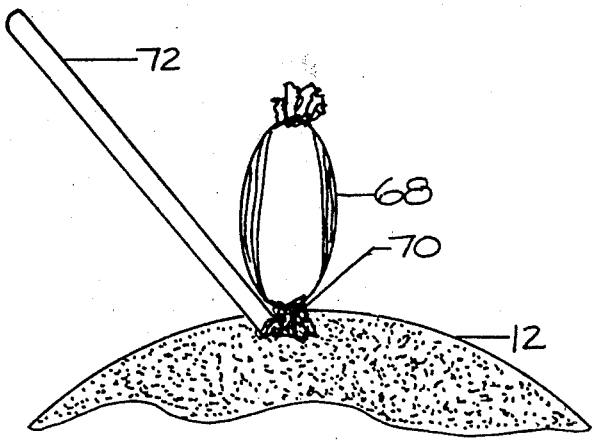

In addition to the method shown in FIG. 10 and 11 of attaching candies 68, FIG. 12 shows an alternate technique of attaching candies. According to this technique, foliage points 74, have barbs such as 76, 78 and 80. These barbs are wrapped with the end 70 if the candy wrapper. Once the wrapper end 70 is around the barbs, the barbs are bent into place thereby securing the candy 68 to the point 74. The point 74 is then pushed into the styrofoam ball thereby securing the candy. While the method of securing the candies to the body ball employing barbs is satisfactory for display or promotional figurines, it is preferred to secure the candies to body ball with the adhesive method as described in connection with FIGS. 10 and 11 in applications where the candy is likely to be eaten by children who may inadvertently ingest the foilage points.

It will be recognized that the candy secured to the body member 12 represents the body clothing of the figurine and the color of the candy can be chosen to color coordinate the figurines other clothing.

Figure 13:
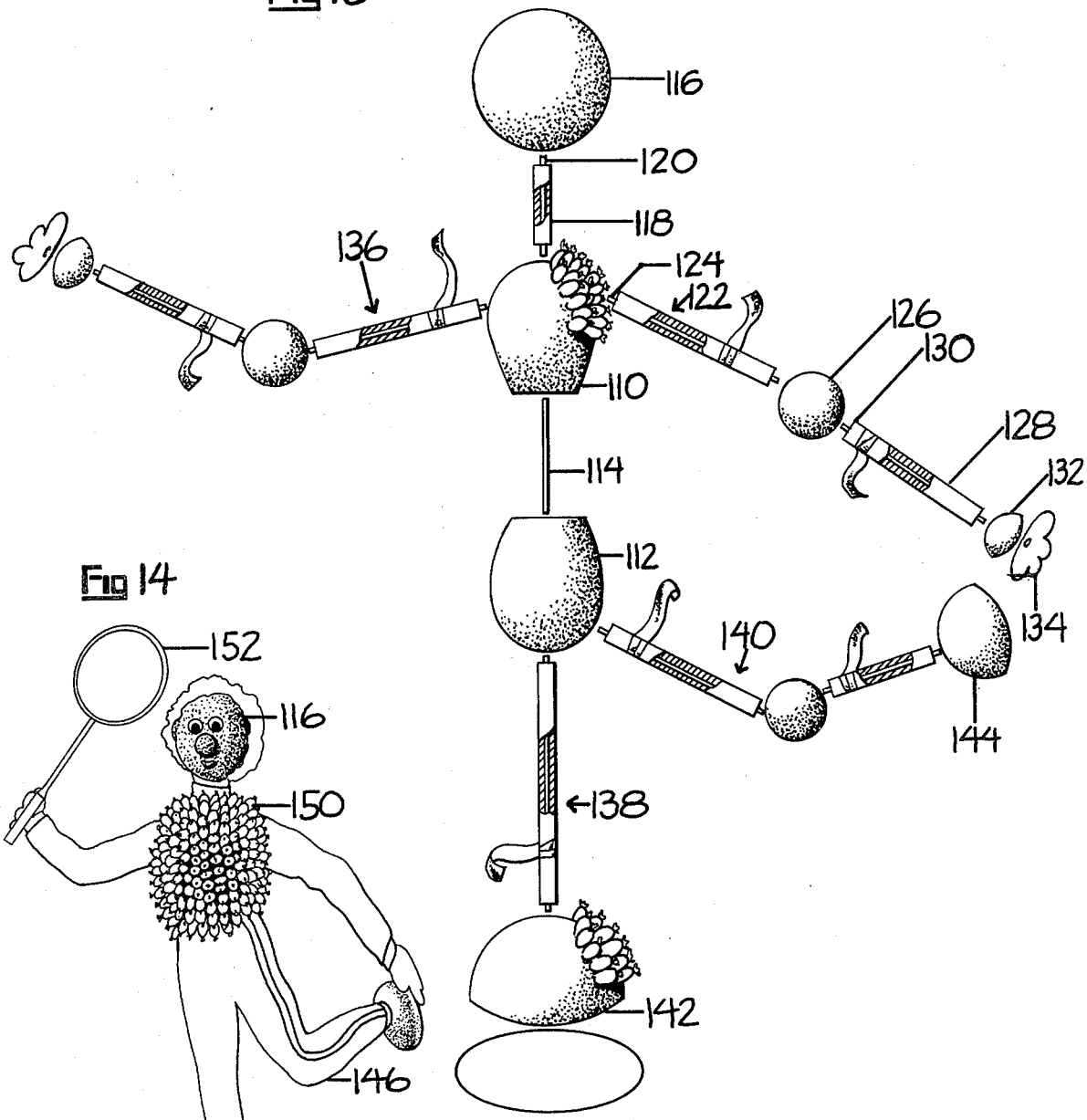
FIG. 13 shows additional steps in the use of this invention for fabricating figurines having elongated characteristics.
Figure 14:
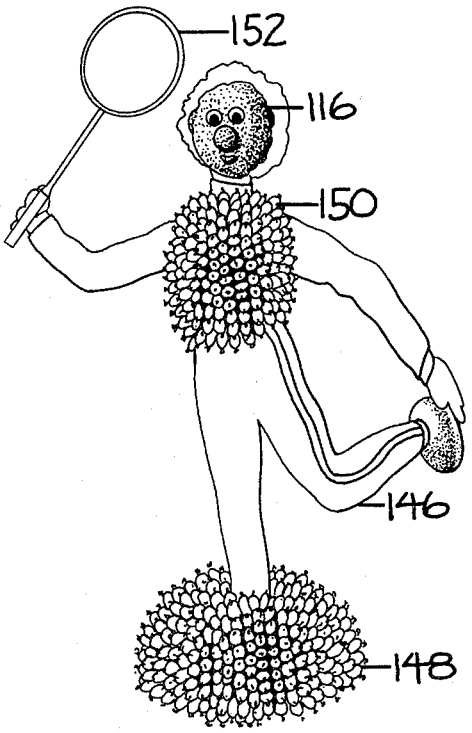
FIG. 14 shows a character having elongated characteristics fabricated according to FIG. 13.

Referring now to FIG. 13, there is shown an alternate embodiment of the present invention for producing figures having more elongated characteristics than the figurine of FIG. 8. For example, the following described embodiment is more suitable for producing characters such as the tennis player shown in FIG. 14. Although the basic techniques of this embodiment for producing elongated figures and the previously discussed embodiments are the same, the present embodiment includes additional steps for achieving the elongated characteristics. Accordingly, the main body portions 110 and 112 are secured to each other in a manner similar to that discussed to FIG. 1. However, as shown, rather than using two spherical-shaped styrofoam balls, two egg-shaped styrofoam balls having the pointed ends removed to produce two flat portions were used. The two flattened ends are then joined together in a manner similar to that discussed with respect to FIG. 1 by a glue-covered elongated member such as stick 114. A spherical styrofoam ball 116 which will be used to create the head of the figurine, is then attached to the top of egg-shaped styrofoam member 110 by means of paper tubing 118 having a selected length which surrounds an elongated member or stick 120 which has a longer length. An exposed end of elongated member 120 is then covered with glue and pushed into the proper locations of egg-shaped styrofoam member 110. The other end of member 120 is then covered with glue and pushed into spherical styrofoam ball 120. In a similar manner, an arm may be created. A tube 122 and an elongated member 124 serves as the upper arm and a small spherical styrofoam ball 126 will serve as an elbow unit onto which is attached another paper tubing member 128 and an elongated member 130. It will be appreciated, of course, that the represented arm can be selected to be at any desired position by means of locating elongated member 130 in a manner necessary to give the desired flexing of the elbow. In a similar manner, a half sphere 132 and a hand member 134 made out of a material such as 6 or 7 ply illustration board or the like may be attached to the other end of stick 130 to create the appearance of a hand. It will be appreciated that hand member 134 is attached to the styrofoam ball half sphere in the same manner as feet 20 were attached to ball 12 in FIG. 1. In a similar manner, arm 136 and legs 138 and 140 may be provided. In the embodiment shown, it will be noted that the half sphere 142 of leg 138 used for support is substantially larger than the half sphere 144 of leg 140 raised in the air. The joints or junctures between the tubing members and the joining styrofoam members may be reinforced by use of sculpture tape in a manner discussed above with respect to FIG. 3, or the junctures may be reinforced by dipping the complete stick figurine into a reinforcing and coloring mixture such as discussed before, and then the mixture allowed to dry thereon. When dried, the facial features of the elongated figurine may then be created in a manner similar to that discussed with respect to FIGS. 4, 5 and 6 above. Likewise, clothing 146 may be attached to the exposed portions of the figurine. The candies 148 and 150 are then secured to the large styrofoam members such as, for example, styrofoam members 110, 112 and 142. The decorative effects such as a tennis racket 152 may be attached. It will be appreciated, of course, that other whimsical figurines could be manufactured such as a golfer, a clown, different types of animals, flowers, etc., etc.

Although the techniques of producing the figurines discussed above was originally used in the production of a great number of figurines, it has been found that small kits including the necessary parts and detailed instructions may be readily packaged such that an individual craftsman may make a selected figurine. More specifically, in one embodiment of the present invention, the figurines are manufactured in a kit form which is sold to the public with only a portion of the figurine assembled. More specifically, a kit comprises a substantially rigid package such as a card board box which carries a figurine structure including body ball or member 12 which has been secured to the head member or ball 10 as by dipping in the reinforcing and coloring mixture described herein above, to give the figurine head structure a flesh tone. Prior to dipping, the ears, eyes and nose are added so that these members are also flesh colored. The juncture between the feet member 20 and the body member 12 is also reinforced by the dipping process described hereinabove which gives the feet member a suitable shoe color. Thus, in kit form, the figurine structure generally located at 152 in FIG. 4, is packaged in a box or other suitable container and has the toy eyes mounted in the eye sockets. The figurine structure will, however, not have the arm members attached or the ribbon wrapped about the arm to provide a sleeve appearance. Instead, the arm and hand combination, will be stored in the kit package together with the other components of the kit which the purchaser will add to the figurine structure to form the completed candy-covered figurine. More specifically, the kit will also include a container of candy of an amount sufficient to cover substantially all of the exposed portion of the body member, ribbon to form the sleeves, and a collar, if desired. A strip of fur fabricated from a synthetic material will also be included to provide the hair together with a hat. It will be recognized that other accessories such as a hat, etc. may be added as necessary or desired.

In the preferred embodiment, head-body and body-feet junctures of the structure 152 are reinforced with the mixture identified above which the proper color additives. It has been found this mixture facilitates the rapid coloring of the head, nose, mouth and ears together with providing an adhesive for the eyes. At the feet-body juncture, the mixture reinforces the juncture and colors the feet.

Thus, although the present invention has been described with respect to specific methods for the production of whimsical figurines, it is not intended that such specific references be considered as limitations on the scope of this invention. Instead, the invention is set forth in the following claims and equivalents thereof.

What is claimed is:

1. A process for manufacturing a figurine partially covered with candy comprising the steps of:

inserting a first end of an elongated member into a styrofoam head member;

inserting the further end of said elongated member into a styrofoam body member thereby joining said head and body members and forming a head and body juncture;

joining a lower extremity member to said styrofoam body member substantially opposite said inserted elongated member thereby forming a body-foot juncture;

mounting ear and mouth members at selected ear and mouth locations on said styrofoam head member;

dipping said head member with said mounted ear and mouth members, below said head and body juncture into a reinforcing mixture to color said styrofoam head member and said ear and mouth members a desired color;

mounting eye members at selected locations on said dipped styrofoam head member;

reinforcing said body-foot juncture;

joining hand and arm members to said styrofoam body members; and securing colorful wrapped candies at selected locations on said styrofoam head and body members.

2. The process of claim 1 and further including the step of forming depressions in said styrofoam head member at selected locations for receiving said eye, ear and mouth members.

3. The process of claim 1 and further including the step of attaching selected decorative details at selected locations on said styrofoam head and body member.

4. The process of claim 1 and further including the steps of covering the first and further ends of said elongated member with adhesive prior to inserting said first end of said elongated member into said styrofoam head member and said further end of said elongated member into said styrofoam body member.

5. A process for manufacturing a figurine partially covered with candy comprising the steps of:

covering a first end of an elongated member with an adhesive and inserting said adhesive covered first end into a styrofoam head member;

covering the further end of said elongated member with adhesive and inserting said further end into a styrofoam body member, thereby joining said head and body members;

joining a lower extremity member to said styrofoam body member at a location substantially opposite said inserted elongated member;

reinforcing the juncture between said styrofoam body member and other selected members joined thereto;

joining hand and arm members to said styrofoam body member;

forming depressions in said styrofoam head member at selected locations for receiving eyes, ears and mouth members;

coloring said styrofoam members to provide desired flesh tones;

securing said eye, ear and mouth members in said depressions;

painting said styrofoam head member to provide facial details;

attaching selected decorative details at selected locations on said members; and securing colorfully wrapped candies at selected locations to said styrofoam members thereby providing a colorful figurine.

6. The process of claim 5 wherein said body and head members are spherical shaped and further comprising the steps of:

flattening a portion of said styrofoam head and body members at the locations where said elongated member is inserted; and pushing said styrofoam head and body members towards each other until they are in contact.

7. The process of claim 5 wherein said styrofoam body and head members are spherical shaped and said lower extremity member is a feet member fabricated from rigid sheet material and further comprising the steps of:

flattening the bottom of said styrofoam body member at a location substantially opposite said styrofoam head member; and joining said feet member at said flattened bottom portion with an adhesive.

8. The process of claim 7 wherein said reinforcing and said coloring steps comprise dipping said styrofoam head and body members into a coloring reinforcing mixture and allowing said mixture to dry on said members.

9. The process of claim 7 wherein said step of joining hand and arm members comprises the steps of:

fabricating said hand and arm members from rigid sheet material; and covering the end of said fabricated hand and arm members opposite the hand end with adhesive and inserting said covered ends in slits in said styrofoam body member.

10. The process of claim 5 and further comprising the steps of:

attaching a small styrofoam spherical-shaped member to the styrofoam head member prior to said reinforcing step to form a nose.

11. The process of claim 5 wherein said step of securing candies comprises the step of covering a portion of said colorful wrapping with glue and pushing said glue-covered wrapping into said styrofoam body member.

12. The process of claim 5 wherein said styrofoam head member has a spherical shape, and said styrofoam body member is formed by removing the pointed end of two egg-shaped styrofoam members to provide flattened areas and joining said two egg-shaped members at said flattened areas, and further comprising the step of covering said elongated member with paper tubing prior to said insertion step to form a neck member.

13. The process of claim 5 wherein said step of joining a lower extremity member comprises the step of joining a leg member comprised of an elongated member covered by paper tubing between said styrofoam body member and a hemispherical-shaped styrofoam foot member.

14. The process of claim 5 wherein said step of joining hand and arm members comprises the steps of:

joining an upper and lower arm member together by means of a small styrofoam elbow member, forming said upper and lower arm members by covering elongated members with paper tubing shorter than said elongated members such that said elongated members extend beyond said paper tubing at both ends and covering one end of each of said extended ends with adhesive and inserting in said styrofoam elbow member;

joining said upper arm member to said styrofoam body member by covering the other extended end of said upper arm member with adhesive and inserting in said styrofoam body member;

joining a wrist member to said lower arm member by covering the other extended end of said lower arm member with adhesive and inserting in a hemispherical-shaped styrofoam wrist member; and joining said styrofoam wrist member to a hand member made of rigid sheet material with adhesive.

15. The process of claims 5, 6, 7, 8 or 9 wherein said reinforcing and coloring steps comprises the steps of:

dipping said styrofoam members into a mixture of a water based acrylic latex polymer, a coloring additive, and water; and allowing mixture to dry.

16. The process of claim 5 or 1 wherein all necessary member and materials used in said process are provided in kit form and further comprising the step of providing detailed instructions for the fabrication of said figurines.

17. A candy-covered figurine comprising:

a head member fabricated from a styrofoam material;

a rigid elongated member having a first and further end, said first end inserted in said styrofoam head member;

ear and mouth members mounted at selected locations on said styrofoam head member;

a body member fabricated from a styrofoam material and joined to said head member by inserting said further end of said rigid elongated member in said body member to form a head-body juncture, said heat-body juncture being reinforced by dipping said head member and said head-body juncture into a reinforcing and covering mixture which serves to cover said head member a preselected color;

a lower extremity member mounted on said styrofoam body member at a location substantially opposite said head-body juncture;

eye members mounted at selected locations on said dipped styrofoam head member;

arm members joined to said styrofoam body member; and a multiplicity of colorful wrapped candies secured at selected location on said styrofoam head and body members.

18. The candy-covered figurine of claim 17 and further including selected decorations attached at selected locations on said styrofoam head and body members.

* * * * *